US005339937A

United States Patent [19]

Bolen

[11] Patent Number: 5,339,937

[45] Date of Patent: Aug. 23, 1994

[54] COIN MECHANISM FOR BULK VENDING MACHINE

[75] Inventor: Richard K. Bolen, Champaign, Ill.

[73] Assignee: The Northwestern Corporation, Morris, Ill.

[21] Appl. No.: 749,437

[22] Filed: Aug. 23, 1991

[51] Int. Cl.[5] ..... G07F 11/44

[52] U.S. Cl. ..... 194/292; 194/334

[58] Field of Search ..... 194/236, 237, 255, 292, 194/334, 338

[56] References Cited

U.S. PATENT DOCUMENTS

| | | | |
|---|---|---|---|
| D. 37,195 | 10/1904 | Townsend . | |
| D. 103,055 | 2/1937 | Main . | |
| D. 154,293 | 6/1949 | Markoe . | |
| D. 156,409 | 12/1949 | Courshon . | |
| D. 180,619 | 7/1957 | Probasco . | |
| D. 309,634 | 7/1990 | McDaniel et al. . | |
| 1,182,793 | 5/1916 | Richardson | 194/255 |
| 1,385,419 | 7/1921 | Baird . | |
| 1,505,725 | 8/1924 | Obradovits . | |
| 2,829,021 | 4/1958 | Wolters . | |
| 3,390,753 | 7/1968 | Bolen et al. . | |
| 3,592,306 | 7/1971 | Dunn | 194/255 |
| 3,604,547 | 9/1971 | Bolen | 194/292 |
| 3,783,986 | 1/1974 | Bolen . | |
| 4,679,684 | 7/1987 | Glaser . | |
| 4,896,798 | 1/1990 | Milton . | |

FOREIGN PATENT DOCUMENTS

| | | | |
|---|---|---|---|
| 0008644 | of 1897 | United Kingdom | 194/255 |

OTHER PUBLICATIONS

Modern Tubular Furniture, 1941, Catalog No. 22, p. 23.
Bulk Vending Machine photographs.

*Primary Examiner*—F. J. Bartuska
*Attorney, Agent, or Firm*—Willian Brinks Hofer Gilson & Lione

[57] ABSTRACT

An improved coin receiving portion for a bulk vending machine, and a method for operation thereof, for accepting coins of a proper denomination and rejecting coins of other than the proper denomination. The improved coin receiving portion includes a coin wheel having a hub for connecting to a handle for operating the coin receiving portion to dispense bulk product and a first slot in the coin wheel for receiving and retaining therein a coin of a proper denomination and for receiving and expelling therefrom coins of other than the proper denomination through a second slot that passes through at least a portion of the hub.

20 Claims, 2 Drawing Sheets

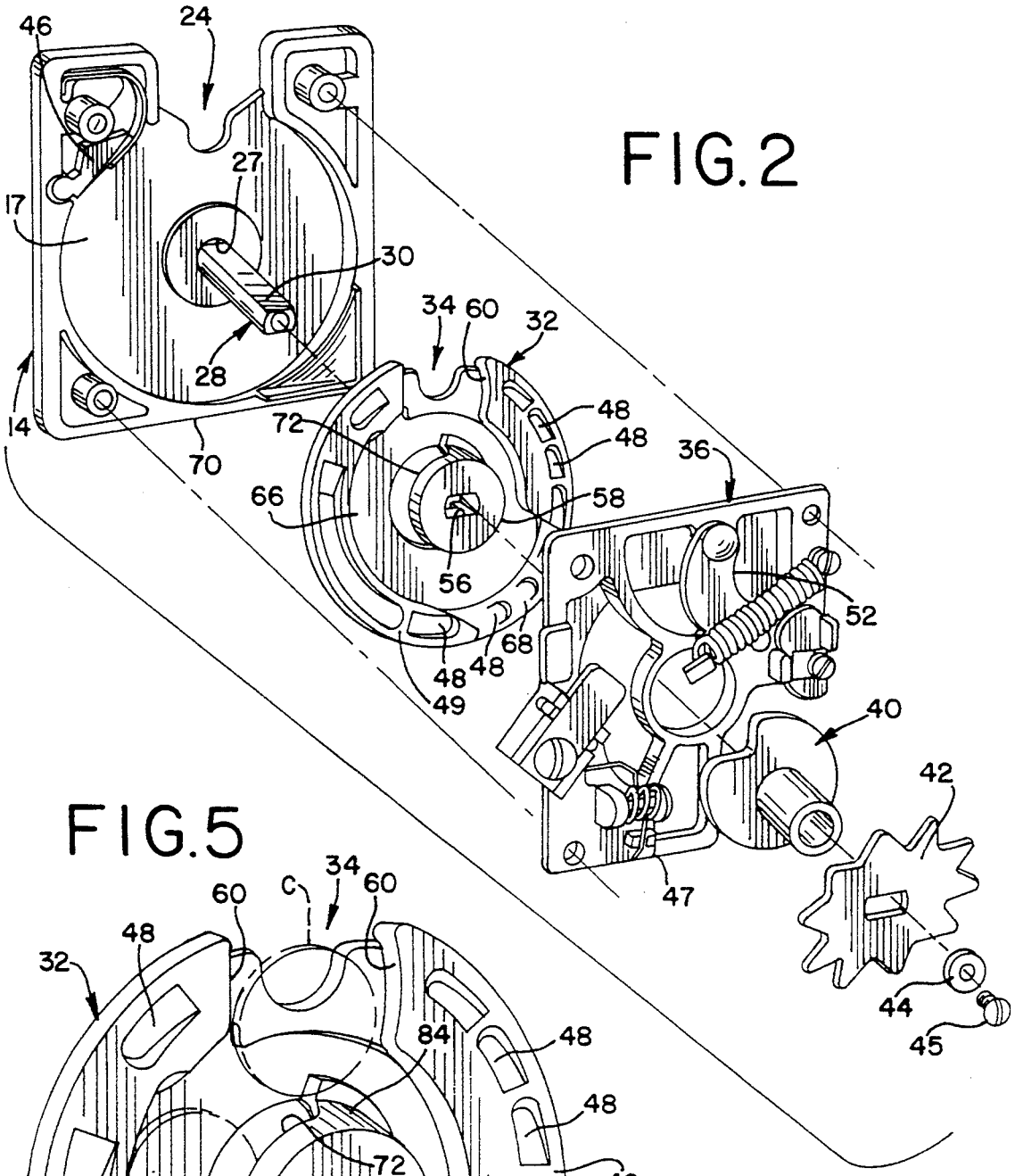
FIG. 2
FIG. 5
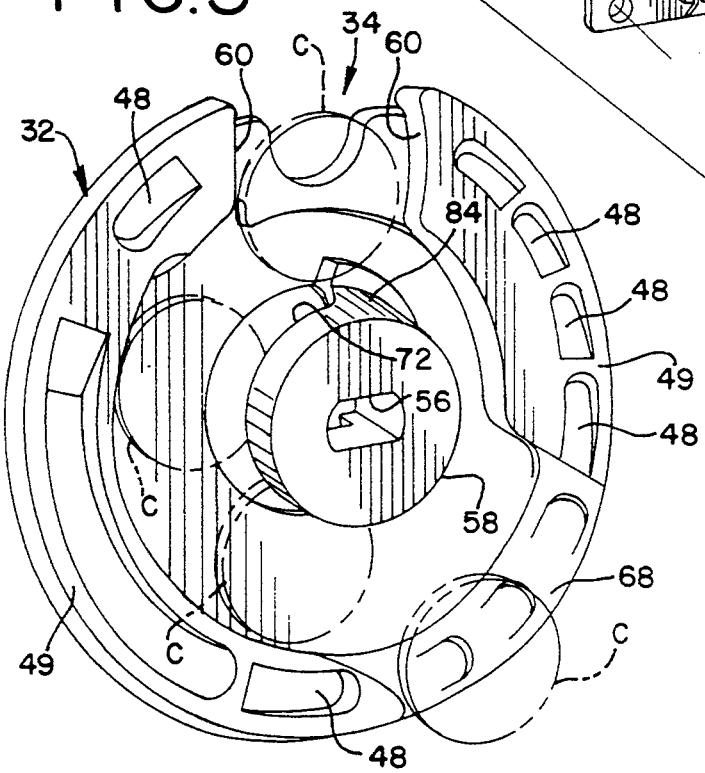

COIN MECHANISM FOR BULK VENDING MACHINE

BACKGROUND OF THE INVENTION

The present invention relates to an improved coin receiving mechanism for a bulk vending machine and a method of operating the mechanism, and more particularly to a bulk vending machine having an improved coin wheel that provides for accepting coins of a predetermined denomination and rejecting coins of other denominations from the mechanism.

Bulk vending machines occupy a special and important position not Just because of the sales generated therefrom but because of the unique niche that these machines possess in the minds of the public. The bulk vending machine has endured and thrived as a fixture of the retail environment. At least one bulk vending machine and more likely several, can be found in the entrance way or lobby of nearly every supermarket, department store, hardware store, gas station and restaurant in the United States. The proceeds of the bulk vending machine may augment the income of the proprietor of the premises where it is located or the proceeds may be shared with or donated to charitable organizations.

The bulk vending machine is intended to operate unattended and without normal supervision or attention by a person of the staff of the establishment where it is located. It is, therefore, important that the bulk vending machine be highly reliable, durable, and resistant to vandalism or pilferage.

One part of the bulk vending machine that is susceptible to vandalism or pilferage is the coin receiving mechanism. The coin receiving mechanism fits into an opening in a housing portion of the bulk vending machine and serves to operate a merchandise dispensing mechanism of the bulk vending machine upon receipt of the proper coin or coins. The coin receiving mechanism typically includes a handle to be manually rotated, a face plate, and a rearward facing gear that engages a corresponding gear of the merchandise dispensing mechanism. The coin receiving mechanism also includes a coin wheel located directly behind a face plate and connected to a rearwardly extending stem or shaft connected to the handle. The coin wheel includes a coin receiving slot sized and adapted to receive a coin of the proper denomination.

The bulk vending machine handle and its connection to the coin wheel in particular should be of a sturdy construction because of the high level of usage to which these pieces are subject. If the handle is jammed or otherwise disabled, the bulk vending machine will not function properly. Also, the handle is potentially subject to vandals who might try to jam the handle in a dispensing position. One way to make a bulk vending machine resistent to vandalism and pilferage is to provide a reinforced collar around the connection of the handle stem or shaft to the coin wheel. The handle stem fits into a slotted aperture in the coin wheel. Accordingly, some prior bulk vending machine mechanisms have coin wheels with raised cylindrical portions or hubs to reinforce the area around the aperture for receiving the stem. In addition, to prevent coins of the improper denomination from being accepted and operating the bulk vending machine, pawls may be used to prevent washers and coins smaller than the required coin from operating the mechanism.

Some bulk vending machines are adapted to dispense bulk product upon receipt of one U.S. quarter. One problem which is encountered in making and operating a bulk vending machine having quarter-slots is that nickels, foreign coins, washers or other disks smaller than a quarter can be inserted in the quarter-slot and either jam the mechanism or be worked on with a knife or other tool in an attempt to operate the dispensing mechanism. Thus, it would be an advantageous feature to be able to reject coins other than the coin of the proper denomination or other objects, such as slugs. It is a particularly desirable feature if the wrong size coin or slug can be readily expelled from the bulk vending machine without jamming the machine.

One way that has been adapted to provide this feature in some types of bulk vending machines is to provide a slot through the coin receiving portion sized slightly smaller than the proper coin so that coins smaller than the proper coin can be expelled by merely dropping through the slot. This feature can be readily provided in bulk vending machines having a coin receiving mechanism with a large front face plate because adequate room can be provided behind the face plate of the coin receiving portion so that coins other than the appropriate sized coin, slugs or other objects can be diverted around the reinforced central hub of the coin wheel and fall out a slot in a lower portion of the coin receiving portion next to the body of the housing. However, some bulk vending machines have coin receiving portions with face plates of a smaller size, e.g. approximately 3½ inches. Such a bulk vending machine is the standard quarter-slot Northwestern Model 60 (M60®) or the Triple Play®. In these and other models of bulk vending machines, there is not adequate space around the reinforced cylindrical portion of the coin wheel to allow disks having a diameter smaller than a quarter to fall through the mechanism.

Accordingly, it is an object of the present invention to provide a mechanism for receiving quarters for use with a type of bulk vending machine, such as the standard M60 or the Triple Play, which prevents jamming by allowing disks having a smaller diameter than a quarter to fall through the mechanism.

It is a further objective of the present invention to provide for a modified coin wheel which can be retrofitted to replace an existing M60 or Triple Play mechanism coin wheel, thus facilitating the conversion of existing mechanisms.

SUMMARY OF THE INVENTION

According to the present invention, there is provided an improved coin receiving portion for a bulk vending machine, and a method for operation thereof, for accepting coins of a proper denomination and rejecting coins of other than the proper denomination. The improved coin receiving portion includes a coin wheel having a hub for connecting to a handle for operating the coin receiving portion to dispense bulk product and a first slot in the coin wheel for receiving and retaining therein a coin of a proper denomination and for receiving and expelling therefrom coins of other than the proper denomination through a second slot that passes through at least a portion of the hub.

According to an aspect of the invention, there is provided a coin wheel for use in a vending machine mechanism comprising a raised cylindrical portion, the raised cylindrical portion having formed therein an opening to allow a disk with a smaller diameter than a required coin to fall through the mechanism, a raised perimeter area having a disk exit area formed therein.

According to another aspect of the invention the required coin is a United States quarter dollar.

According to a further aspect of the invention the vending machine mechanism is a M60.

According to a further aspect of the invention, there is provided a coin wheel for use in a vending machine mechanism comprising a circular disk having a backside and a frontside, the frontside being flat, the backside having a raised cylindrical portion formed in its center, the raised cylindrical portion having a top face and a side portion, said top face having formed in its center an opening passing through the frontside to allow a shaft to pass through, the backside having formed therein a raised perimeter area, the raised perimeter area having formed therein notches which allow interaction with a spring-loaded pawl, the raised perimeter area having formed therein a disk exit area, the raised perimeter area having formed therein a coin slot, the side portion having an opening formed therein.

According to a further aspect of the invention, there is provided a M60 style vending machine mechanism comprising a face plate having a center hole formed therein, face plate having formed therein a slot for receiving quarters; a knob; a shaft attached to the knob and passing through the hole in the face plate; a backplate having an opening formed therein; a spring loaded pawl movably attached to the backplate; a washer pawl for stopping counter-clockwise movement movably attached to the inside of the face plate; a coin wheel received in an indention formed in a backside of the face plate, the coin wheel having formed in its center a raised cylindrical portion, the raised cylindrical portion having a top face and a side portion, the top face having formed in its center an opening to allow the shaft to pass through, the coin wheel having formed therein a raised perimeter area, the raised perimeter area having formed therein notches which allow interaction with the spring-loaded pawl to prevent clockwise movement of said coin wheel, the raised perimeter area having formed therein a disk exit area, the raised perimeter area having formed therein a coin slot, the side portion having an opening formed therein for allowing a disk of smaller diameter than a quarter to pass through from the coin slot to the disk exit area.

According to a still further aspect of the invention there is provided a method for operating a vending machine comprising the steps of: accepting a coin of a required size; rejecting a disk of a size smaller than said required size by passing said disk through an opening formed in a raised cylindrical portion of a coin wheel.

BRIEF DESCRIPTION OF THE FIGURES

FIG. 2 is a perspective exploded view of an embodiment of the coin receiving mechanism, which is shown installed in the bulk vending machine of FIG. 1.

FIG. 5 is a perspective view of the embodiment of the coin wheel of FIGS. 2, 3 and 4 depicting the path of expelling of a disk other than the coin of the proper denomination.

DETAILED DESCRIPTION OF A PREFERRED EMBODIMENT

Figure 1:
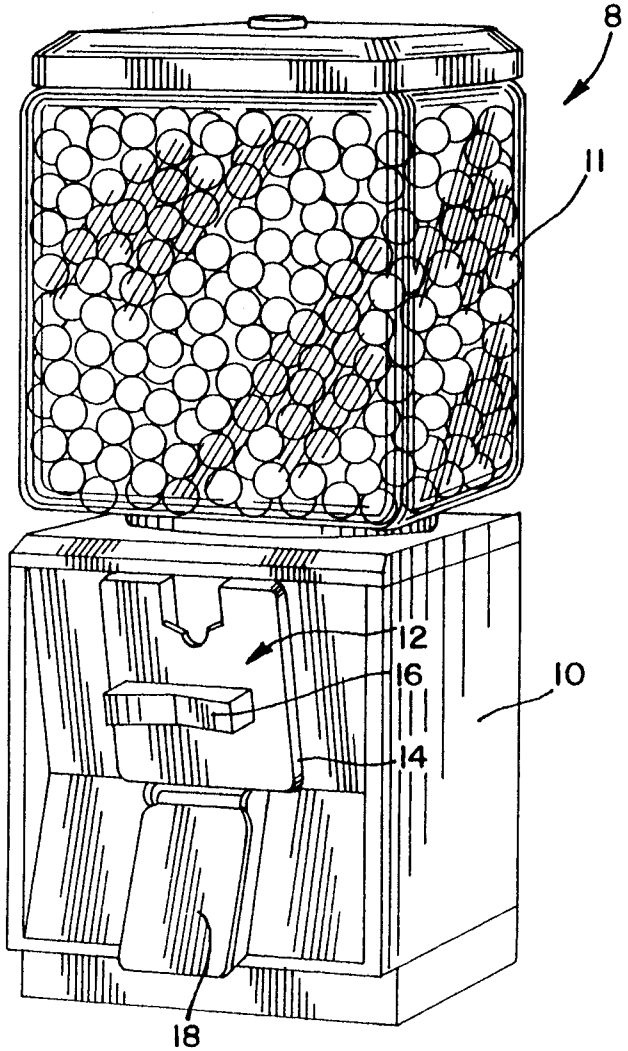
FIG. 1 is a perspective view of a bulk vending machine incorporating an embodiment of the present invention.

Referring to FIG. 1, there is shown a bulk vending machine 8. In one embodiment, the bulk vending machine 8 is a standard M60® bulk vending machine made by the Northwestern Corp. of Morris, Ill. The bulk vending machine 8 includes a base unit 10 and a product holder 11. The base unit 10 may be a generally rectangular metal housing. The product holder 11 may be made of a molded high strength clear plastic. The present embodiment may be incorporated in bulk vending machines other than the M60®, such as the Triple Play®, also made by the Northwestern Corp., or other bulk vending machines. The bulk vending machine 8 may be mounted on, or include, a stand (not shown), typically having a heavy base portion and a post extending from the base portion to engage the base unit 10.

The bulk vending machine 8 includes a coin receiving portion 12. The coin receiving portion 12 is mounted in a forwardly oriented opening in the base unit 10. The coin receiving portion 12 includes a front plate 14 and a handle 16. The coin receiving portion 12 actuates a product dispensing portion (not shown) located inside of the base unit 10 upon the payment of a coin of the proper denomination into the coin receiving portion 12 and the operation of the handle 16 in a manner that is well known in the art. Dispensing of the product by the product dispensing portion is via a chute 18 located adjacent to the coin receiving portion 12 also located on the base unit 10.

Referring to FIG. 2, the coin receiving portion 12 includes the front plate 14. The front plate 14 has a rear side 17. The front plate 14 mounts into an opening in the base unit 10, thereby mounting the coin receiving portion 12 into the base unit 10. The front plate 14 may be generally rectangular in shape and includes a slot 24 located on an upper side for receiving a coin. In the M60 and the Triple Play bulk vending machines, the front plate 14 is approximately $3\frac{3}{8}$ inches wide and $3\frac{1}{2}$ inches high.

Extending through a centrally located opening 27 in the front plate 14 is a handle stem 28. The opening in the front plate 14 for receiving the handle stem 28 is sized and adapted to allow the handle stem 28 to rotate with respect to the front plate 14. The handle stem 28 is connected to the handle 16. The handle stem 28 preferably has a keyed shape, e.g. flattened sides 30.

Mounted on the handle stem 28 and engaging the keyed sides 30 thereof is a coin wheel 32. The coin wheel 32 is a planar disk shaped member having front and rear sides. The coin wheel 32 has located therein a first slot 34 located along the perimeter for receiving a coin of a proper denomination. The coin wheel 32 is mounted between the front plate 14 and a rear frame 36. Also mounted on the handle stem 28 are a cam 40 and a gear 42. A washer 44 and a mounting screw 45 connect to the stem 28 to maintain the coin wheel 32, cam 40, and gear 42 mounted thereon. The gear 42 engages the product dispensing portion (not shown) as mentioned above. On the inner side 17 of the front plate 14, there is a movably attached spring loaded stop 46 to prevent clockwise movement of the coin wheel 32 unless a proper size coin (e.g. a quarter) is located in the first coin slot 34. The rear frame 36 has mounted thereon a spring loaded pawl 47 which abuts up against and engages a wall formed in notches 48 located in a perimeter area 49 of the coin wheel 32 to prevent rotation of the coin wheel 32 in other than its proper direction, e.g. counter-clockwise. Also attached to the back plate 36 is a return lever 52 which abuts against the cam 40 which is attached to the stem 28. Working together, the cam 40 and return lever 52 return the handle 16 to the starting position when it is turned.

In a preferred embodiment, the coin wheel 32 is made of cast aluminum and has a diameter of approximately $2\frac{7}{8}$ inches. The coin wheel 32 includes a keyed opening 56 formed in its center for receiving and engaging the handle stem 28. The coin wheel 32 also includes a raised cylindrical portion or hub 58 located around the opening 56. The raised cylindrical portion 58 provides for reinforcing the connection of the handle stem 28 to the coin wheel and thereby to the coin receiving portion 12 and to the rest of the bulk vending machine 8 to make it more durable and resistant to vandalism or pilferage. In a preferred embodiment, the raised cylindrical portion 58 has a diameter of approximately $\frac{7}{8}$ inches. In a preferred embodiment, the perimeter area 49 containing the slots 48 occupies an area of approximately $\frac{1}{4}$ inches along the perimeter of the coin wheel 32.

Figure 3:
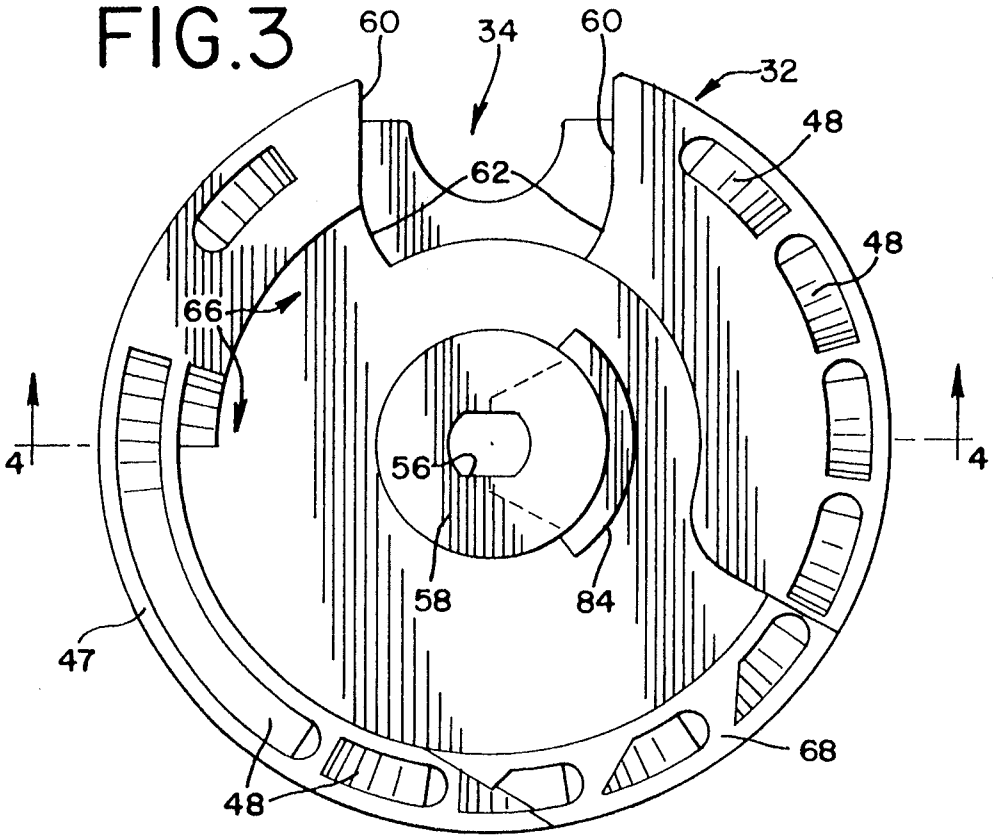
FIG. 3 is a front view of an embodiment of a coin wheel shown in FIG. 2.
Figure 4:
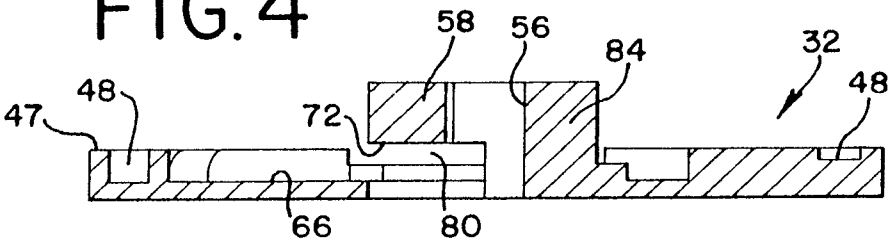
FIG. 4 is a cross sectional view taken along 4—4' of FIG. 3.

As shown in FIGS. 3 and 4, the coin wheel 32 has the first slot 34 located in a portion thereof to receive a coin of a proper denomination. The first slot 34 is located on the rear side of the coin wheel 32 and open to the perimeter to receive a coin therefrom. The first slot 34 includes side walls 60 sized and adapted to conform to the dimensions of a coin of a proper denomination. In the present embodiment, the coin of proper denomination is a U.S. quarter, so accordingly, the walls 60 are spaced approximately 15/16 inches apart. The walls 60 curve toward each other in lower portions 62 thereof to retain the coin of the proper denomination in position in the first slot of the coin wheel 32.

As mentioned above, it is desirable to be able to reject and expel coins of other than the proper denomination or other objects, e.g. slugs, that may be inserted into the coin receiving portion 32. Coins or other objects larger than the coin of the proper denomination, will not fit in the first slot 34 defined by the walls 60 of the coin wheel 32. It is also advantageous to expel coins or other objects smaller than the coin of the proper denomination that could be fitted into the first slot 34 formed by the walls 60. As mentioned above, some bulk vending machines have a coin dispensing mechanism with a large size face plate so that adequate room may be provided behind the large face plate and around a reinforced raised central hub to provide a passageway for expelling coins or other objects of other than the proper denomination around the hub and out a slot open to a lower edge of the coin receiving portion. However, in a bulk vending machine, such as the M60 or Triple Play, that has a coin receiving portion face plate that is relatively small, e.g. approximately $3\frac{1}{2}$ inches across, there is insufficient room around the reinforced central hub to provide this feature. Considering specifically the coin receiving mechanism used in the M60 and Triple Play, once sufficient space is allocated on the coin wheel 32 (diameter $2\frac{7}{8}$ inches) for the raised cylindrical portion 58 (diameter $\frac{7}{8}$ inches) and the slotted perimeter 49 ($\frac{1}{4}$ inch times $2=\frac{1}{2}$ inch), there is only about $\frac{5}{8}$ inch available on the coin wheel between the inner diameter of the slotted perimeter 49 and the outer diameter of the raised cylindrical portion 58. Although $\frac{5}{8}$ inches would be adequate to provide for passage of some common U.S. coins, e.g. pennies, dimes, a slot of $\frac{5}{8}$ inches would not be wide enough to pass a nickel which has a diameter of approximately 13/16 inches. Therefore, with the type of coin wheel used in this type of bulk vending machine, there has not been a way to expel a nickel by dropping it past the coin wheel and out the bottom of the coin receiving portion.

However, according to the present embodiment, a drop through feature is provided by means of an improved coin wheel construction. In the coin wheel 32 of the present embodiment, a coin slot (or second slot) 66 is formed in the rear side of the coin wheel 32. The coin slot 66 is located on the coin wheel rear side along and radially inward of the perimeter area 49. The coin slot 66 extends from the first coin slot 34 to an area 68 of the coin wheel. The area 68 is opposite from the first coin slot 34 and would correspond to a lower portion of the coin wheel when the coin wheel is in place in the bulk vending machine and in an "at rest" or starting position with the slot 34 oriented upward. At the area 68, the coin slot 66 passes through or across the raised perimeter area 49. A lower edge 70 of the face plate 14 is sized and adapted to be spaced from the housing unit 10 to provide room for coins that travel in the slot 66 to fall out the bottom of coin receiving portion 12 at the bottom of the face plate 14.

In order to provide a dimension sufficient to accommodate coins up to, but not including, a quarter, the slot is approximately $\frac{7}{8}$ inches wide. Therefore, if a coin, such as a nickel which is approximately $\frac{5}{8}$ inches wide, is inserted into the first slot 34, it will fall through the second coin slot 66 and out the bottom of the coin receiving portion 12. In order to provide the second slot 66 with a width dimension of $\frac{7}{8}$ inch, the second slot 66 passes through a portion of the raised cylindrical hub 58. In passing through the hub 58, the second slot 66 forms a third (or hub) slot 72 extending laterally into a side of the hub 58.

In a preferred embodiment, the coin wheel is formed by a casting process. Referring to FIG. 4, in order to provide the slotted area 72 through the hub 58, a cavity 80 is formed from the other side (i.e. the front side of the coin wheel) through the plane of the coin wheel 32 and part of the way into the hub 58. Thus, the hub 58 is connected to the rest of the coin wheel 32 by a portion 84. With the construction of the coin wheel 32 illustrated in FIGS. 2–5, there is provided a reinforced hub 58 that is secure and resistant to wear and damage. Also with the construction illustrated in FIGS. 2–5, there is provided a coin path 66 that allows for coins other than the proper coin to fall through, and thereby be expelled. Further, these features are provided in a coin wheel 32 that fits in a coin receiving mechanism 12 that can be used in the M60 and the Triple Play and other bulk vending machines.

FIG. 5 shows the path of an undersized coin or washer as it passes along the second coin path 66 of the coin wheel 32. In operation, if a coin or disk smaller than a quarter is placed in the first slot 34 and is not large enough to be hung up on the coin slot bottom edges 62, it will fall through the second slot 66 passing through the third slot 72 in the raised cylindrical portion 58, and ride along the second slot 66 where it will exit through the area 68. In addition, if a coin or disk smaller than a quarter is placed in the first coin slot 34 and hangs up on the coin slot bottom edges 62, the spring-loaded stop 46 will prevent clockwise movement of the handle 16.

In the embodiment of the coin wheel shown in FIGS. 2–5, if the coin inserted into slot 34 is the proper size, e.g. a quarter, the coin wheel and the coin receiving mechanism operate in the same manner as had been done in prior devices. Specifically, the proper size coin remains in the first slot 34 and rides therein as the coin wheel is rotated clockwise. When the wheel is inverted, the coin falls out into a tray located internally to the housing for secure storage until it is emptied.

It is a further advantage of the present embodiment, that the improved coin wheel can not only be used in new models of the M60 and Triple Play, but can also to retrofitted in older models by replacing the older style coin wheel with a coin wheel such as shown in FIGS. 2–5.

It is a further advantage that bulk vending machines can be readily adapted in the future to accommodate coins of other dimensions, e.g. half-dollars or dollars, by replacing an old coin wheel with a new one having a slot therein sized to allow coins of other than proper denomination to fall through and out the bottom of the coin receiving mechanism.

It is intended that the foregoing detailed description be regarded as illustrative rather than limiting and that it is understood that the following claims including all equivalents are intended to define the scope of the invention.

I claim:

1. A coin wheel for use in a vending machine mechanism comprising:

a raised cylindrical portion having a top surface and a side surface, said top surface having formed therein a first opening to allow a handle stem to pass through the coin wheel, and a second opening formed in said side surface with a portion of said raised cylindrical portion overlaying the second opening to allow a disk with a smaller diameter than a required coin to fall through the mechanism;

a raised perimeter area having a disk exit area formed therein.

2. The coin wheel of claim 1, wherein the vending machine is a M60.

3. The coin wheel of claim 1, wherein said required coin is a United States quarter dollar.

4. The coin wheel of claim 1, wherein said second opening is formed on one side of a central axis of said raised cylindrical portion.

5. The coin wheel of claim 1, wherein the second opening in the raised cylindrical portion is formed by a casting process.

6. A coin wheel for use in a vending machine mechanism comprising:

a circular disk having a backside and a frontside, said frontside being flat, said backside having a raised cylindrical portion formed in its center, said raised cylindrical portion having a top face and a side portion, said top face having formed in its center an opening passing through said frontside to allow a shaft to pass through, said backside having formed therein a raised perimeter area, said raised perimeter area having formed therein notches which allow interaction with a spring-loaded pawl, said raised perimeter area having formed therein a disk exit area, said raised perimeter area having formed therein a coin slot, said side portion having an opening formed therein with a portion of said raised cylindrical portion overlaying the opening for allowing a disk of smaller diameter than a required coin to pass from said coin slot through said side portion opening between said raised perimeter area and said shaft.

7. The coin wheel of claim 6 wherein said vending machine mechanism is a M60 style quarter-slot vending machine.

8. The coin wheel of claim 6, wherein said circular disk is formed by a casting process.

9. The coin wheel of claim 6, wherein said opening in said side portion of said raised cylindrical area being formed by a casting process.

10. A coin receiving mechanism for a vending machine comprising:

a face plate having a center opening formed therein, said face plate formed therein a slot for receiving quarters;

a shaft passing through said center opening in said face plate;

a backplate having an opening formed therein;

a coin wheel received in an indention formed in a backside of said face plate, said coin wheel having formed in its center a raised cylindrical portion, said raised cylindrical portion having a top face and a side portion, said top face having formed in its center an opening to allow said shaft to pass through, said coin wheel having formed therein a raised perimeter area, said raised perimeter area having formed therein a coin slot, said side portion having an opening formed therein with a portion of said raised cylindrical portion overlaying said opening for allowing a disk of smaller diameter than a quarter to pass from said slot between said shaft and said raised perimeter area.

11. The mechanism of claim 10, further comprising a disk exit area formed in said raised perimeter area.

12. The mechanism of claim 10 wherein the vending machine mechanism is a quarter-slot vending machine having a coin wheel with an approximate diameter of $2\frac{7}{8}$ inches, and a raised cylindrical portion with an approximate diameter of the $\frac{7}{8}$ inches, and a raised perimeter portion occupying an area of approximately $\frac{1}{4}$ inches along the perimeter of the coin wheel.

13. A vending machine mechanism comprising:

a face plate having a center hole formed therein, said face plate having formed therein a slot for receiving quarters;

a knob;

a shaft attached to said knob and passing through said hole in said face plate;

a backplate having an opening formed therein;

a spring loaded pawl movably attached to said backplate;

a washer pawl for stopping counter-clockwise movement movably attached to said inside of said face plate;

a coin wheel received in an indention formed in a backside of said face plate, said coin wheel having formed in its center a raised cylindrical portion, said raised cylindrical portion having a top face and a side portion, said top face having formed in its center an opening to allow said shaft to pass through, said coin wheel having formed therein a raised perimeter area, said raised perimeter area having formed therein notches which allow interaction with the spring-loaded pawl to prevent clockwise movement of said coin wheel, said raised perimeter area having formed therein a disk exit area, said raised perimeter area having formed therein a coin slot, said side portion having an opening formed therein with a portion of said raised cylindrical portion overlaying said opening for allowing a disk of smaller diameter than a quarter to pass through said coin slot through said side portion opening between said shaft and said raised perimeter area to said disk exit area.

14. The vending machine mechanism of claim 13 wherein the vending machine mechanism is a M60 style quarter-slot vending machine having a coin wheel with an approximate diameter of $2\frac{7}{8}$ inches, and a raised cylindrical portion with an approximate diameter of the $\frac{7}{8}$ inches, and a raised perimeter portion occupying an area of approximately $\frac{1}{4}$ inches along the perimeter of the coin wheel.

15. A method for operating a vending machine comprising:

accepting a coin of a required size;

rejecting a disk of a size smaller than said required size by passing said disk through an opening formed in a side portion of a raised central cylindrical portion of a coin wheel, said central cylindrical portion having said side portion and a face portion, said face portion having a handle stem passing through an opening formed at its center and wherein a portion of said central cylindrical portion overlays the opening formed in the side portion.

16. The method of claim 15 further comprising:

discharging said disk through a disk exit area formed in a raised perimeter area of said coin wheel.

17. In a bulk vending machine having a coin receiving portion for accepting coins of a proper denomination and rejecting coins of other than the proper denomination and actuating a merchandise dispensing mechanism upon payment of one or more coins of the proper denomination into the coin receiving portion and operation of a handle associated with the coin receiving portion, an improvement comprising:

a coin wheel having:

a central hub, said central hub having a first portion and a second portion, said first portion comprising a solid central shaft portion for connecting to the handle for operating the coin receiving portion, said second portion surrounding said central shaft portion; and a first slot for receiving and retaining therein a coin of a proper denomination; and for receiving and expelling therefrom a coin of other than the proper denomination through a second slot formed in a laterally oriented side of said second portion of said central hub wherein a portion of said central hub overlays said second slot for allowing said coin of other than proper denomination to pass through a portion of the central hub.

18. The improvement of claim 17 in which the second slot opens to a lower side of the coin wheel so that a coin of other than the proper denomination can pass to the lower side of the coin wheel.

19. The improvement of claim 17 in which the coin wheel is formed by a casting process.

20. The improvement of claim 17 in which the coin wheel comprises:

a generally planar portion having a first side and a second side located opposite from the first side, the planar portion including the first slot on a side thereof for receiving a coin of the proper denomination; and a raised portion located centrally on one side of the generally planar portion and defining said central hub, said planar portion having a cavity open to the second side of said planar portion and extending through the planar portion to the first side of said planar portion and into the second portion of said central hub to define the second slot.

* * * * *

UNITED STATES PATENT AND TRADEMARK OFFICE

CERTIFICATE OF CORRECTION

PATENT NO. : 5,339,937

DATED : August 23, 1994

INVENTOR(S) : Richard K. Bolen

It is certified that error appears in the above-indentified patent and that said Letters Patent is hereby corrected as shown below:

Column 8,

In Claim 10, line 4, after "plate" insert --having--.

Signed and Sealed this

Nineteenth Day of September, 1995

*Attest:*

Bruce Lehman

BRUCE LEHMAN

*Attesting Officer*

*Commissioner of Patents and Trademarks*